US010161398B2

(12) United States Patent
Saga

(10) Patent No.: US 10,161,398 B2
(45) Date of Patent: Dec. 25, 2018

(54) VARIABLE DISPLACEMENT OIL PUMP

(71) Applicant: HITACHI AUTOMOTIVE SYSTEMS, LTD., Hitachinaka-shi, Ibaraki (JP)

(72) Inventor: Koji Saga, Ebina (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 343 days.

(21) Appl. No.: 14/884,310

(22) Filed: Oct. 15, 2015

(65) Prior Publication Data

US 2016/0153325 A1 Jun. 2, 2016

(30) Foreign Application Priority Data

Dec. 1, 2014 (JP) ..... 2014-242716

(51) Int. Cl.

| | |
|---|---|
| ***F04C 14/22*** | (2006.01) |
| ***F04C 2/344*** | (2006.01) |
| ***F01M 1/16*** | (2006.01) |
| ***F01M 1/02*** | (2006.01) |

(52) U.S. Cl.

CPC ..... *F04C 14/226* (2013.01); *F01M 1/02* (2013.01); *F01M 1/16* (2013.01); *F04C 2/344* (2013.01); *F01M 2001/0238* (2013.01); *F01M 2001/0246* (2013.01); *F01M 2001/0253* (2013.01)

(58) Field of Classification Search

CPC .. F01M 1/16; F01M 2001/0246; F04C 14/226
See application file for complete search history.

(56) References Cited

U.S. PATENT DOCUMENTS

| | | | |
|---|---|---|---|
| 3,924,969 | A | 12/1975 | Rometsch et al. |
| 5,518,380 | A | 5/1996 | Fujii et al. |
| 6,530,752 | B2 | 3/2003 | Oba et al. |
| 6,672,844 | B2 | 1/2004 | Fukanuma et al. |

(Continued)

FOREIGN PATENT DOCUMENTS

| | | |
|---|---|---|
| EP | 2 253 847 A1 | 11/2010 |
| JP | 59-070891 A | 4/1984 |

(Continued)

OTHER PUBLICATIONS

Saga: Non-Final U.S. Office Action on U.S. Appl. No. 14/073,347 dated Aug. 14, 2015.

(Continued)

*Primary Examiner* — Mary A Davis
(74) *Attorney, Agent, or Firm* — Foley & Lardner LLP

(57) ABSTRACT

In a variable displacement oil pump, a drain chamber 36 partitioned with respect to first and second control oil chambers 31, 32 and which serves to generate a biasing force in a concentric direction based on a pump drain pressure directly introduced from a drain port 22*a* is interposed between first control oil chamber 31 which serves to generate a biasing force in the concentric direction in which a volume variation quantity of a plurality of pump chambers PR for a cam ring 15 based on a control pressure as a main gallery pressure introduced from an internal combustion engine and second control oil chamber 32 which serves to generate the biasing force in an eccentric direction in which the volume variation quantity of the plurality of pump chambers PR is increased for cam ring 15 based on the control pressure.

13 Claims, 13 Drawing Sheets

(56) References Cited

U.S. PATENT DOCUMENTS

| | | | | |
|---|---|---|---|---|
| 7,794,217 | B2 | 9/2010 | Williamson et al. | |
| 8,317,486 | B2 | 11/2012 | Williamson et al. | |
| 8,684,702 | B2 | 4/2014 | Watanabe et al. | |
| 8,690,544 | B2 * | 4/2014 | Ono | F04C 14/226 418/30 |
| 9,109,596 | B2 | 8/2015 | Ohnishi et al. | |
| 9,410,514 | B2 | 8/2016 | Watanabe | |
| 9,494,152 | B2 | 11/2016 | Saga | |
| 9,494,153 | B2 | 11/2016 | Watanabe et al. | |
| 9,670,925 | B2 | 6/2017 | Watanabe et al. | |
| 9,670,926 | B2 * | 6/2017 | Ohnishi | F04C 14/226 |
| 2008/0308062 | A1 | 12/2008 | Morita et al. | |
| 2009/0022612 | A1 | 1/2009 | Williamson et al. | |
| 2009/0291000 | A1 | 11/2009 | Saga et al. | |
| 2010/0028171 | A1 | 2/2010 | Shulver et al. | |
| 2010/0205952 | A1 | 8/2010 | Yamamuro et al. | |
| 2010/0329912 | A1 | 12/2010 | Williamson et al. | |
| 2011/0085921 | A1 | 4/2011 | Kato et al. | |
| 2011/0123379 | A1 | 5/2011 | Saga et al. | |
| 2011/0194967 | A1 | 8/2011 | Watanabe et al. | |
| 2012/0213655 | A1 | 8/2012 | Ohnishi et al. | |
| 2013/0089446 | A1 | 4/2013 | Williamson et al. | |
| 2013/0164162 | A1 | 6/2013 | Saga | |
| 2013/0164163 | A1 | 6/2013 | Ohnishi et al. | |
| 2013/0195705 | A1 | 8/2013 | Williamson et al. | |
| 2014/0072456 | A1 | 3/2014 | Watanabe et al. | |
| 2014/0072458 | A1 | 3/2014 | Watanabe | |
| 2014/0119969 | A1 | 5/2014 | Iijima | |
| 2014/0147322 | A1 | 5/2014 | Saga | |
| 2014/0219847 | A1 | 8/2014 | Watanabe et al. | |
| 2015/0020759 | A1 | 1/2015 | Watanabe et al. | |
| 2015/0218983 | A1 | 8/2015 | Watanabe et al. | |
| 2016/0090983 | A1 * | 3/2016 | Miyajima | F04C 14/226 418/16 |
| 2016/0177950 | A1 | 6/2016 | Watanabe et al. | |
| 2017/0030351 | A1 | 2/2017 | Saga | |
| 2017/0184096 | A1 * | 6/2017 | Tanasuca | F04C 14/226 |

FOREIGN PATENT DOCUMENTS

| | | | |
|---|---|---|---|
| JP | 2004-218529 | A | 8/2004 |
| JP | 2008-524500 | A | 7/2008 |
| JP | 2011-080430 | A | 4/2011 |
| JP | 2011-111926 | A | 6/2011 |
| JP | 2013-130090 | A | 7/2013 |
| JP | 2014-105623 | A | 6/2014 |
| WO | WO-2012/113437 | A1 | 8/2012 |

OTHER PUBLICATIONS

Saga: Non-Final U.S. Office Action on U.S. Appl. No. 15/290,394 dated Aug. 10, 2017.
Saga: U.S. Notice of Allowance on U.S. Appl. No. 14/073,347 dated Jul. 21, 2016.
Saga: Final U.S. Office Action on U.S. Appl. No. 14/073,347 dated Apr. 8, 2016.
Watanabe et al.: U.S. Notice of Allowance on U.S. Appl. No. 13/852,636 dated Mar. 24, 2016.
Watanabe et al.: U.S. Notice of Allowance on U.S. Appl. No. 13/974,686 dated Feb. 1, 2017.
Watanabe et al.: U.S. Notice of Allowance on U.S. Appl. No. 14/073,357 dated Jun. 29, 2016.
Watanabe et al.: Non-Final U.S. Office Action on U.S. Appl. No. 13/852,636 dated Aug. 28, 2015.
Watanabe et al.: Non-Final U.S. Office Action on U.S. Appl. No. 14/073,357 dated Aug. 31, 2015.
Watanabe et al.: Non-Final U.S. Office Action on U.S. Appl. No. 13/974,686 dated Mar. 24, 2016.
Watanabe et al.: Non-Final U.S. Office Action on U.S. Appl. No. 14/923,715 dated May 16, 2017.
Watanabe et al.: U.S. Corrected Notice of Allowability on U.S. Appl. No. 14/923,715 dated Nov. 3, 2017.
Watanabe et al.: U.S. Notice of Allowance on U.S. Appl. No. 14/923,715 dated Oct. 18, 2017.
Saga: U.S. Office Action on U.S. Appl. No. 15/290,394 dated Feb. 5, 2018.
Watanabe et al.: U.S. Notice of Allowance on U.S. Appl. No. 15/584,283 dated Feb. 22, 2018.
Saga: U.S. Notice of Allowance on U.S. Appl. No. 15/290,394 dated May 2, 2018.
Saga: U.S. Supplemental Notice of Allowability on U.S. Appl. No. 15/290,394 dated May 17, 2018.

* cited by examiner

VARIABLE DISPLACEMENT OIL PUMP

BACKGROUND OF THE INVENTION (1) Field of the Invention

The present invention relates to a variable displacement oil pump applicable to a hydraulic pressure source from which oil is supplied to, for example, respective slide sections of an internal combustion engine for use in an automotive vehicle.

(2) Description of Related Art

A Japanese Patent Application first Publication No. 2014-105623 exemplifies a previously proposed variable displacement oil pump applicable to the internal combustion engine of the automotive vehicle.

That is to say, in this variable displacement oil pump, a main gallery pressure of the engine, namely, a hydraulic pressure of drained oil after a passage of an oil filter is fed back to a pair of first and second control oil chambers partitioned between a pump housing and a cam ring so as to be mutually opposed so that an eccentricity of the cam ring is variably controlled according to the main gallery pressure. Thus, an energy loss based on a difference pressure between the drain pressure and the main gallery pressure during a drive of the pump is reduced.

SUMMARY OF THE INVENTION

However, in a case of the previously proposed variable displacement oil pump, it is necessary to install a drain passage partitioned for the respective control oil chambers to be not communicated at back sides of the respective control oil chambers when a drained oil is introduced into a main gallery. A large sizing of the pump in an axial direction of the pump by the drain passage and by a partitioning wall partitioning this drain passage is resulted.

With the above-described technical task of the previously proposed variable displacement oil pump in mind, it is an object of the present invention to provide a variable displacement oil pump which can suppress the large sizing in the axial direction of the pump while adopting the structure of feedback controlling by means of the main gallery pressure.

According to one aspect of the present invention, there is provided a variable displacement oil pump, comprising: a pump element rotationally driven by means of an internal combustion engine and which absorbs oil via an absorption section and drains oil via a drain section when an internal volume of a plurality of pump chambers is varied; a variable mechanism which increases or decreases a volume variation quantity of the plurality of pump chambers according to a movement of a movable member; a biasing member installed in a state in which a pre-load is acted and which biases the movable member in a direction in which the volume variation quantity of the plurality of pump chambers is increased; a first control oil chamber which serves to generate a biasing force in a direction in which the volume variation quantity of the plurality of pump chambers is decreased for the movable member according to a hydraulic pressure introduced from the internal combustion engine; a second control oil chamber which serves to generate the biasing force in a direction in which the volume variation quantity of the plurality of pump chambers is increased for the movable member according to the hydraulic pressure introduced from the internal combustion engine; a control mechanism which controls a hydraulic pressure introduced into the first control oil chamber and the second control oil chamber; and a drain chamber partitioned with respect to the first control oil chamber and the second control oil chamber and which serves to generate the biasing force in a direction in which the volume variation quantity of the plurality of pump chambers is varied on a basis of the hydraulic pressure directly introduced from the drain section.

According to another aspect of the present invention, there is provided a variable displacement oil pump, comprising: a rotor rotationally driven by means of an internal combustion engine; a plurality of vanes housed to be projectable from and retractable into an outer periphery of the rotor; a cam ring partitioning a plurality of pump chambers by housing the rotor and the vanes in an inner peripheral side of the cam ring and increasing or decreasing a volume variation quantity of a plurality of pump chambers by eccentrically moving with respect to the rotor; an absorption section which is opened to an absorption region in which an internal volume of the pump chambers is increased; a drain section which is opened to a drain region in which the internal volume of the pump chambers is decreased; a biasing member installed in a state in which a pre-load is acted and which biases the cam ring in a direction in which an eccentricity is increased; a first control oil chamber which serves to generate a biasing force in a direction in which a volume variation quantity of the plurality of pump chambers is decreased for the cam ring according to a hydraulic pressure introduced from the internal combustion engine; a second control oil chamber which serves to generate the biasing force in a direction in which the volume variation quantity of the plurality of pump chambers is increased for the cam ring according to the hydraulic pressure introduced from the internal combustion engine; a control mechanism which controls the hydraulic pressure introduced into the first control oil chamber and the second control oil chamber; and a drain chamber partitioned with respect to the first control oil chamber and the second control oil chamber and which serves to generate a biasing force in a direction in which the volume variation quantity of the plurality of pump chambers is varied on a basis of the hydraulic pressure directly introduced from the drain section.

According to the present invention, oil drained from the drain section can be supplied to the internal combustion engine without intervention of an oil passage partitioned in an axial direction of first and second control oil chambers and superposed. Consequently, the large sizing of the axial direction of the pump can be avoided.

DETAILED DESCRIPTION OF THE INVENTION

Hereinafter, each of preferred embodiments of a variable displacement oil pump according to the present invention will be described in details on a basis of the accompanied drawings. It should be noted that, in each of the preferred embodiments described below, this variable displacement oil pump is an application example of an oil pump to supply a lubricating oil of an internal combustion engine to a slide section of the engine of an automotive vehicle and to a valve timing control apparatus for a valve open and closure control for an engine valve.

First Embodiment

Figure 1:
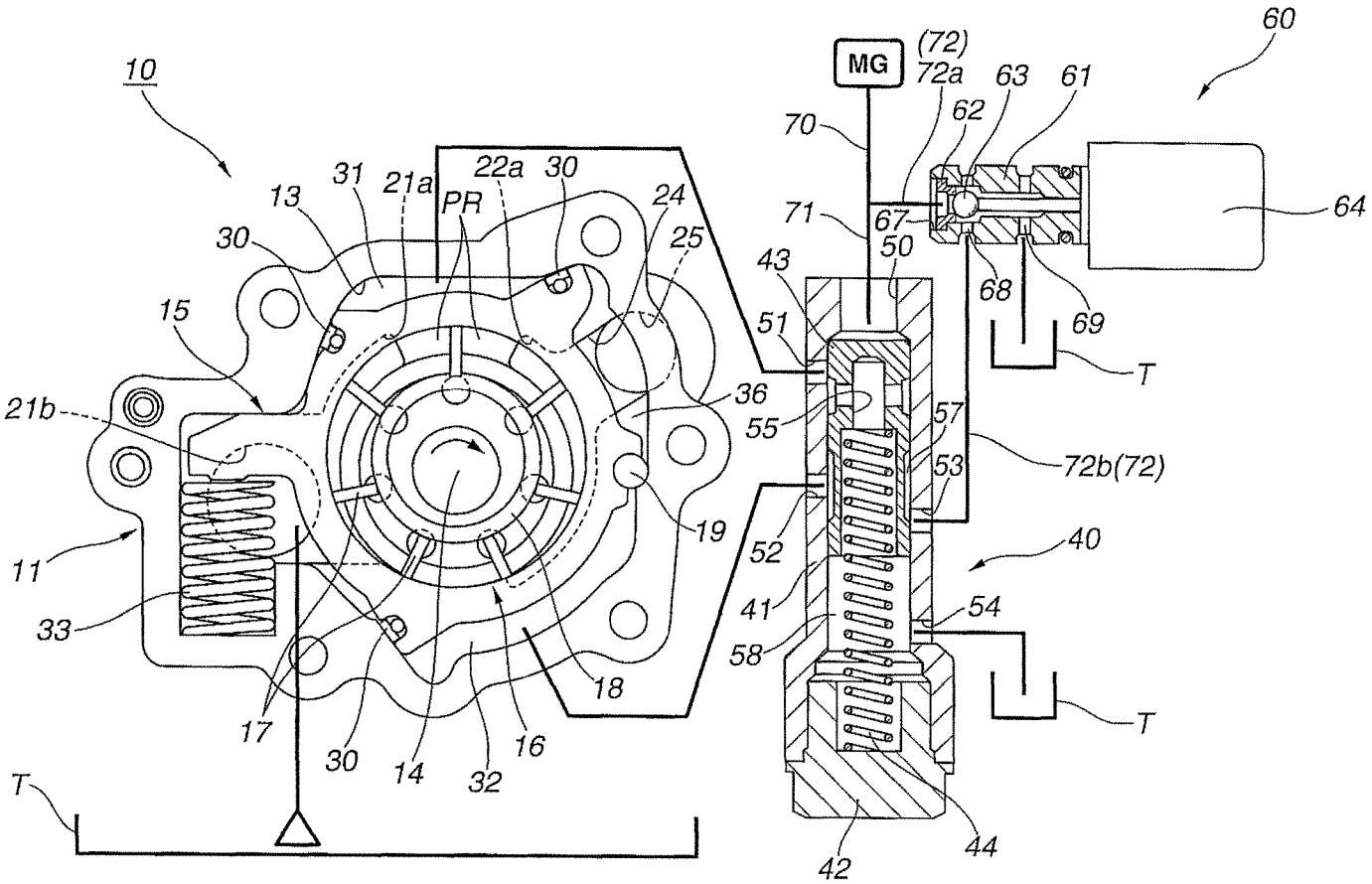
FIG. 1 is a hydraulic pressure circuit diagram of a variable displacement oil pump in a first preferred embodiment according to the present invention.

FIGS. 1 through 8(*b*) show a first preferred embodiment of the variable displacement oil pump according to the present invention. This oil pump 10 is installed, for example, on a front end section of a cylinder block (not shown) of the internal combustion engine. This oil pump 10, as shown in FIG. 1, includes: a pump housing having a pump body 11 of longitudinally cross sectioned substantially letter U shape, whose one end side is opened, and in which a pump housing chamber 13 is disposed at an inside of pump body 11 and a cover member 12 which closes an opening end of pump body 11; a drive shaft 14, rotatably supported on the pump housing, penetrated through a substantially center section of pump housing chamber 13, and rotationally driven by means of a crankshaft (not shown); a cam ring 15 which is a movable member movably (or swingably) housed in pump housing chamber 13 and constituting a variable mechanism which modifies a volume variation quantity of a pump chamber PR as will be described later in cooperation with first and second control oil chambers 31, 32 and a coil spring 33; a pump element housed in an inner peripheral side of cam ring 15 and which performs a pump action by increasing or decreasing a volume of a plurality of pump chambers PR formed with cam ring 15 when the pump element is rotationally driven in a clockwise direction in FIG. 1 by means of drive shaft 14; a pilot valve 40 installed at the downstream side of an oil main gallery MG of the internal combustion engine and which is a control mechanism controlling a supply or an exhaust of the hydraulic pressure for first and second control oil chambers 31, 32 as will be described later; and a solenoid valve 60 installed in an oil passage (a second introduction passage 72 as will be described later) branched from oil main gallery MG and which is a switching mechanism switching controlling an introduction of a control pressure introduced from oil main gallery MG to pilot valve 40.

It should herein be noted that the pump element is constituted by: a rotor 16 rotatably housed in an inner peripheral side of cam ring 15 and having a center section fitted to an outer peripheral surface of drive shaft 14; a plurality of vanes 17 housed to be projectable from and retractable within a plurality of slits 16*a* radially cut out on an outer peripheral section of rotor 16; and a pair of ring members 18, 18 disposed on both side sections of the inner peripheral side of rotor 16.

Figure 2:
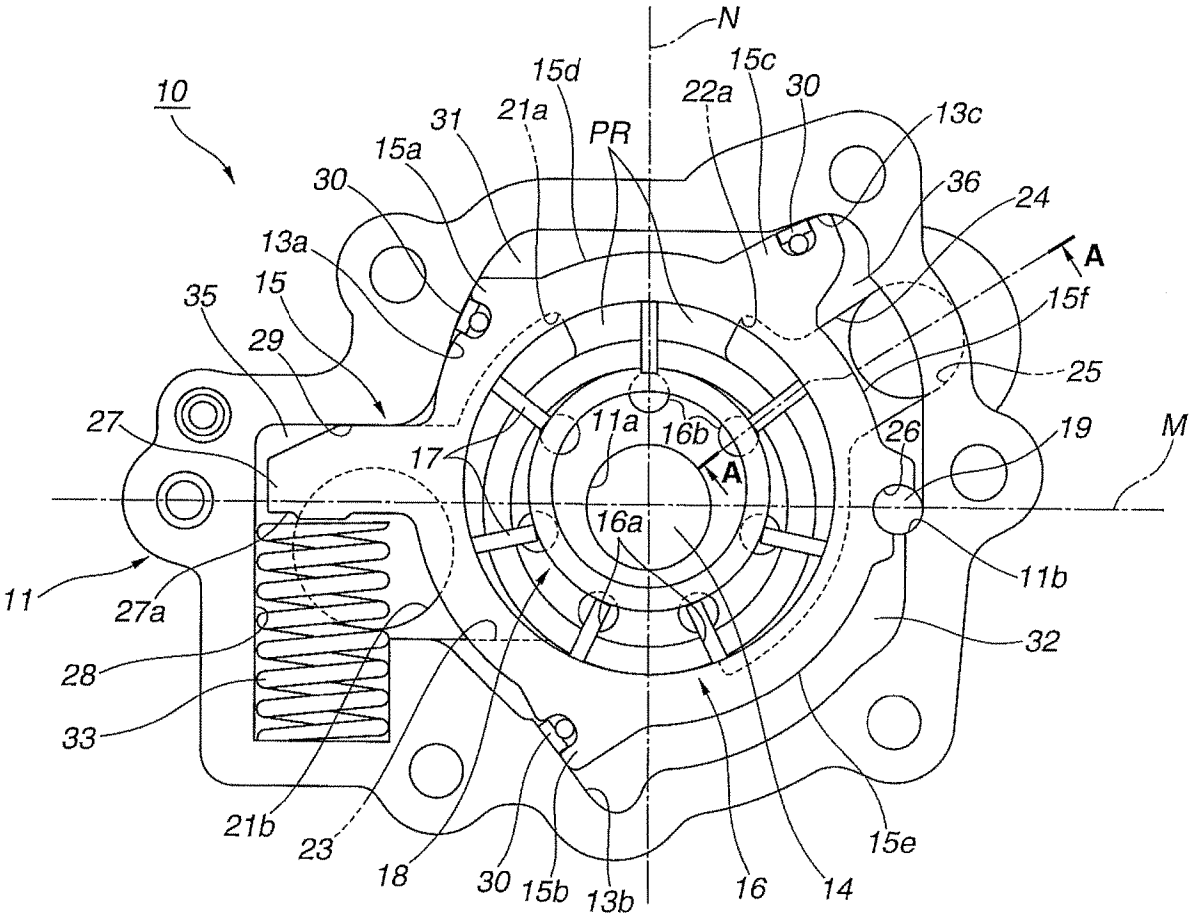
FIG. 2 is an enlarged view of the variable displacement oil pump shown in FIG. 1.

Pump body 11 is integrally formed of an aluminum alloy material. Especially, as shown in FIG. 2, a bearing hole 11*a* which rotatably supports one end section of drive shaft 14 is penetrated through a substantially center position of an end wall of pump housing chamber 13. In an outer peripheral area of bearing hole 11*a*, an absorption port 21*a* which is an absorption section of a substantially arc recess shape and which is opened to a region (hereinafter, called an absorption region) in which a volume of each pump chamber PR is enlarged due to a pump action of the pump element and a drain port 22*a* which is a drain section of substantially arc recess shape and which is open to a region (hereinafter, called a drain region) in which the volume of each pump chamber PR is reduced are cut out so as to oppose with each other via bearing hole 11*a*.

A support groove 11*b* of laterally cross sectioned substantially semicircular shape is cut out at a predetermined position of an inner peripheral wall of pump housing chamber 13. This support groove 11*b* swingably supports cam ring 15 via a bar shaped pivot pin 19. Furthermore, a first seal slidably contact surface 13*a* is formed in a range corresponding to the absorption region which is an upper half side in FIG. 2 with respect to a straight line M (hereinafter, called a cam ring reference line) connecting a center of bearing hole 11*a* to a center of support groove 11*b* from among an inner peripheral wall of pump housing chamber 13. A third seal slidably contact surface 13*c* is formed in a range corresponding to the drain region which is the upper half side in FIG. 2 with respect to straight line M. On first seal slidably contact surface 13*a*, a seal member 30 fitted to an outer peripheral section of cam ring 15 is at all times slidably contactable. On third seal slidably contact surface 13*c*, seal member 30 fitted to the outer peripheral section of cam ring 15 is at all times slidably contactable. On the contrary, in a range corresponding to the absorption region which is a lower half in FIG. 2 with respect to cam ring reference line M, a second seal slidably contact surface 13*b* on which seal member 30 fitted to the outer peripheral section of cam ring 15 is at all times slidably contactable is formed.

An introduction section 23 which is formed to protrude toward a spring housing chamber 28 side as will be described later is integrally installed at a substantially middle position of a peripheral direction of absorption port 21*a*. An absorption inlet 21*b* is penetrated through a proximity of a boundary section between introduction part 23 and absorption port 21*a*. Absorption inlet 21*b* penetrates through an end wall of pump body 11 and opens externally. According to the structure described above, oil reserved into an oil pan T of the internal combustion engine is absorbed into pump chamber PR related to the absorption region via absorption inlet 21*b* and absorption port 21*a* on a basis of a negative pressure generated according to the pump action by means of the pump element.

It should herein be noted that absorption inlet 21*b* is communicated with a low pressure chamber 35 formed in an outer peripheral area of cam ring 15 in the absorption region together with introduction section 23. Oil of a low pressure which is the absorption pressure is introduced into low pressure chamber 35.

Figure 3:
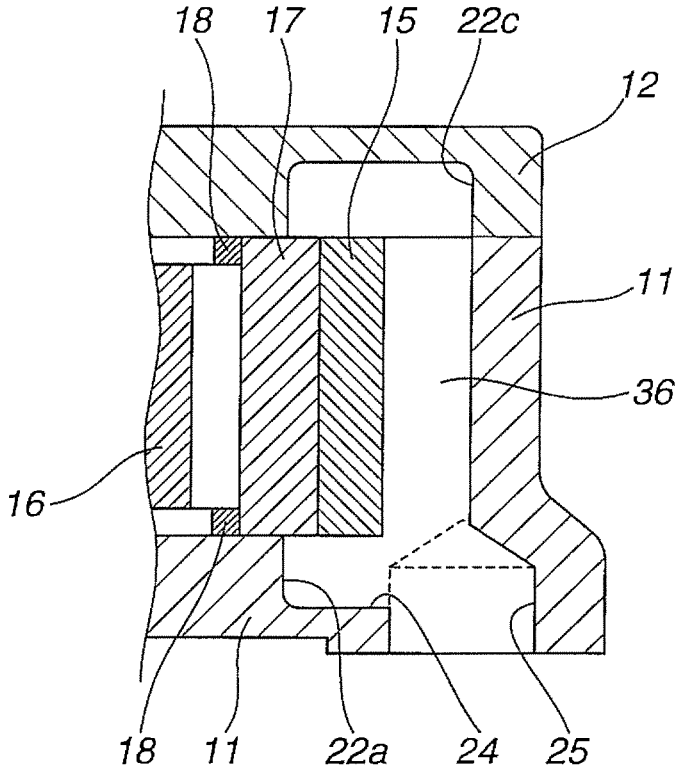
FIG. 3 is a cross sectional view cut away along a line A-A shown in FIG. 2.

On the other hand, a communication groove 24 constituting a drain passage by communicating drain port 22*a* with a drain chamber 36 as will be described later is cut out on the outer peripheral side of a start end section of drain port 22*a*, as shown in FIGS. 1 through 3. A drain hole 25 is penetrated along an axial direction at an outer side end section of this communication groove 24. This drain hole 25 is used to drain oil drained from the pump element and introduced into drain port 22*a* via communication groove 24 by penetrating the end wall of pump body 11 to open externally to oil main gallery MG via a filter (not shown). This drain hole 25 is installed so that a part of drain hole 25 is directly opened to drain chamber 36 as will be described later, namely, the part of drain hole 25 is superposed on drain chamber 36 as will be described later.

In addition, absorption port 21*a* and drain port 22*a* are cut out at an inner side surface of cover member 12 in the same way as pump body 11. Another absorption port 21*c* and another drain port 22*c* structured in the same way as absorption port 21*a* and drain port 22*a* are opposed against absorption port 21*a* and drain port 22*a*. It should be noted that communication groove 24 and drain hole 25 are installed only at pump body 11 side.

An axial one end of drive shaft 14 which is penetrated through the end wall of pump body 11 to be exposed to the external is interlinked with the crankshaft (not shown) and rotates rotor 16 in a clockwise direction in FIG. 2 on a basis of a rotational force transmitted from the crankshaft.

It should be noted that, as shown in FIG. 2, a straight line N (hereinafter, called a "cam ring eccentric direction line") passing through a center of drive shaft 14 and orthogonal to cam ring reference line M provides a boundary between the absorption region and the drain region.

The plurality of slits 16*a* formed radially from the center side of rotor 16 toward an outside of the radial direction are cut out. Back pressure chambers 16*b*, each of back pressure chambers 61*b* being in a laterally cross sectioned surface of a substantially circular shape and each of which introduces drain oil, are installed at inside basic end sections of respective slits 16*a*. Each vane 17 is pushed out toward the external according to a centrifugal force due to the rotation of rotor 16 and a pressure within each back pressure chamber 16*b*.

Each vane 17 has a corresponding tip surface slidably contacted on an inner peripheral surface of cam ring 15 during the rotation of rotor 16 and has a corresponding base end surface slidably contacted on an outer peripheral surface of each ring member 18, 18. That is to say, each vane 17 is pushed up toward the outside of the radial direction of rotor 16 by means of each ring member 18, 18. Even if an engine revolution speed is low and the centrifugal force and the pressure of each back pressure chamber 16*b* are small (low), each tip of vanes 17 is slidably contacted on an inner peripheral surface of cam ring 15 so that each pump chamber PR is partitioned in a liquid tight manner.

Cam ring 15 is integrally formed in a substantially cylindrical shape by a, so-called, sintered metal. A pivot section 26 of a substantially arc recess groove shape which constitutes an eccentric swing fulcrum by fitting pivot section 26 into a pivot pin 19 is cut out along the axial direction of pump 10 at a predetermined position of the outer peripheral section of cam ring 15. In addition, an arm section 27 which interlinks with a coil spring 33 which is a biasing member set to a predetermined spring constant is projected along a radial direction of pump 10 at a position opposite to pivot section 26 via the center of cam ring 15. It should be noted that a pressing force projection section 27*a* formed in a substantially arc convex shape is projected at one side section of a movement (pivotal) direction of arm section 27. By contacting at all times pressing force projection section 27*a* on a tip of coil spring 33, arm section 27 is interlinked with coil spring 33.

A spring housing chamber 28 housing and holding coil spring 33 is installed adjacently to pump housing chamber 13 along the direction of cam ring eccentric direction line N in FIG. 2 at a position opposed against support groove 11*b*, at an inside of pump body 11. Coil spring 33 is elastically installed, having a predetermined set weight W1, between one end wall of spring housing chamber 28 and arm section 27 (pressing force projection section 27*a*).

It should be noted that the other end wall of spring housing chamber 28 is structured as a limitation section 29 which limits a movement range in the eccentric direction of cam ring 15. By contacting the other side section of arm section 27 on limitation section 29, a more movement in the eccentric direction of cam ring 15 is limited.

In this way, cam ring 15 is at all times biased toward a direction (the clockwise direction in FIG. 2 and hereinafter called an "eccentric direction") in which an eccentricity of cam ring 15 is increased via arm section 27 by a biasing force of coil spring 33. In a non-operation state, as shown in FIG. 2, the other side section of arm section 27 is pressed on limitation section 29 so that cam ring 15 is limited to the position at which the eccentricity of cam ring 15 becomes maximum.

First, second, and third seal constituent sections 15*a* through 15*c* having concentric arc shaped seal surfaces with first, second, and third seal slidable contact surfaces 13*a* through 13*c* installed on the inner peripheral wall of pump housing chamber 13 are projected from the outer peripheral section of cam ring 15. Respective seal members 30 are housed and held on seal surfaces of respective seal constituent sections 15*a* through 15*c*.

It should be noted that each seal member 30 is formed to be elongated in the straight line manner along the axial direction of cam ring 15 by a fluorine-based resin material having, for example, a low frictional characteristic, backed up by a rubber made elastic member, and pressed against each seal slidable contact surface 13*a* through 13*c*. Thus, the partitioning is established in a liquid tight manner between each seal slidable contact surface 13*a* through 13*c* and the seal surface of each seal constituent section 15*a* through 15*c*.

In the seal structure described above, a pair of first and second control oil chambers 31, 32 are partitioned at an outer peripheral section of cam ring 15 by means of seal member 30 housed and held into first and second seal constituent sections 15*a*, 15*b* and pivot pin 19. A controlled pressure as will be described later as a hydraulic pressure within the internal combustion engine is introduced into first and second control oil chambers 31, 32 through a controlled pressure introduction passage 70 which is branched from main oil gallery MG. Specifically, the controlled pressure (hereinafter, simply called a "controlled pressure") corresponding to the hydraulic pressure within the internal combustion engine which is a drain pressure of the pump decreased via a pass of an oil filter (not shown) is supplied to first control oil chamber 31 from control pressure introduction passage 70 via a first introduction passage 71 which is one of branch passages branched into two from control pressure introduction passage 70 and is supplied to second control oil chamber 32 via a second introduction passage 72 which is the other of the branch passages and solenoid valve 60.

In this way, a moving force (a swing force) for cam ring 15 is provided by acting the controlled pressure on a first pressure receiving surface 15*d* and a second pressure receiving surface 15*e* structured on the outer peripheral surface of cam ring 15 facing first and second control oil chambers 31, 32, respectively. It should herein be noted that a pressure receiving area of second pressure receiving surface 15*e* is larger (wider) than the pressure receiving area of first pressure receiving area 15*d* and is set to be smaller (narrower) than the pressure receiving area which is a sum of the pressure receiving area of first pressure receiving area 15*d* and the pressure receiving area of third pressure receiving surface 15*f* as will be described later. In a case where the same hydraulic pressure is acted on each pressure receiving surface 15*d* through 15*f*, cam ring 15 is biased in a direction in which, as a whole, its eccentricity is reduced (in a counterclockwise direction in FIG. 2 and called a "concentric direction").

A drain chamber 36 is partitioned by means of seal member 30 housed and held in third seal constituent section 15*c* and pivot pin 19 between the peripheral direction of first control oil chamber 31 and second control oil chamber 32. A pump drain pressure itself (hereinafter, called simply, a "pump drain pressure") drained from the pump element is introduced via a communication groove 24 into drain chamber 36. By acting the pump drain pressure on third pressure receiving surface 15*f*, cam ring 15 is biased in the concentric direction in cooperation with first control oil chamber 31.

In the structure as described above, in oil pump 10, when a biasing force based on an inner pressure of first, second control oil chambers 31, 32 and drain chamber 36 with respect to set weight W1 of coil spring 33 is small, cam ring 15 becomes the maximum eccentric state shown in FIG. 2. On the other hand, when the biasing force based on the inner pressures of first and second control oil chambers 31, 32 and drain chamber 36 due to the increase in the pump drain pressure is in excess of set weight W1 of coil spring 33, cam ring 15 is moved in the concentric direction in accordance with the drain pressure.

Figure 4:
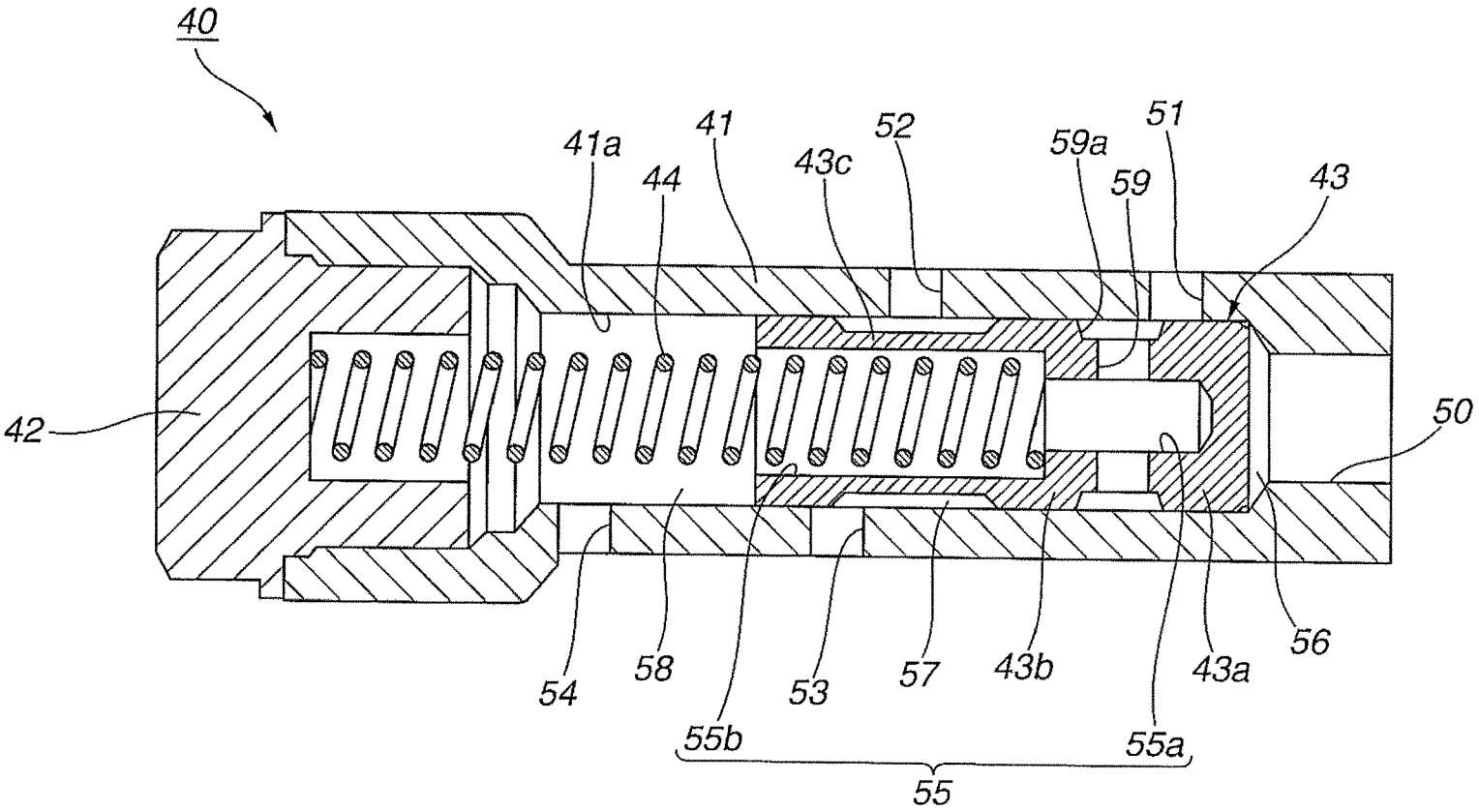
FIG. 4 is an enlarged view of a pilot valve shown in FIG. 1.

Pilot valve 40 is, as shown in FIG. 4, mainly constituted by: a valve body 41 formed substantially cylindrically, whose one end side opening is connected to first introduction passage 71 via an introduction port 50 as will be described later, and whose other end side opening is closed by a plug 42; a spool valve body 43 slidably housed in an inner peripheral side of valve body 41 and which serves to perform a supply and exhaust control of the hydraulic pressure for first and second control oil chambers 31, 32 by means of a pair of large-diameter first land section 43*a* and second land section 43*b* which slidably contact on an inner peripheral surface of valve body 41; and a valve spring 44 elastically installed with a predetermined set weight W2 between plug 42 and spool valve body 43 on an inner periphery of the other end side of valve body 41 and which at all times biases spool valve body 43 toward one end side of valve body 41.

A straight body figure valve housing section 41*a* is drilled in a range of valve body other than axial directional both end sections and constituting an inner diameter substantially the same diameter as an outer diameter of spool valve body 43 (an outer diameter of each land section 43*a*, 43*b*). Spool valve body 43 is housed within valve housing section 41*a*. Introduction port 50 is opened at axial one end section of valve body 41. Introduction port 50 serves to introduce the control pressure by connecting to first introduction passage 71. A plug 42 is screwed to the other end section of valve body 41 via a female screw section formed on an inner peripheral section of the other end section.

A first connection port 51 is opened which is connected to first control oil chamber 31 at axial one end side position of a peripheral wall of valve housing section 41*a*. A second connection port 52 is opened which is connected to second control pressure chamber 32 at a intermediate position in the axial direction. A supply/exhaust port 53 which serves to supply and exhaust the hydraulic pressure to second control oil chamber 32 is opened by connecting to solenoid valve 60 via a passage 72*b* (hereinafter called simply "downstream side passage) at a downstream side of second introduction passage 72. A drain port 54 which serves to exhaust the hydraulic pressure of first and second control oil chambers 31, 32 introduced via an internal passage 55 as will be described later is opened at the axial other end side position.

Spool valve body 43 has axial both end sections on which first and second land sections 43*a*, 43*b* are formed and a small diameter axle section 43*c* is interlinked between both first and second land sections 43*a*, 43*b*. This spool valve body 43 is housed within valve housing section 41*a*. Therefore, at an inside of valve housing section 41*a*, a pressure chamber 56 interposed between first land section 43*a* and valve body 41 and to which the control pressure is introduced via introduction port 50, a relay chamber 57 interposed between both land sections 43*a*, 43*b* and which serves to relay between second connection port 52 and supply/exhaust port 53 as will be described later, and aback pressure chamber 58 interposed between second land section 43*b* and plug 42 and which serves to exhaust the hydraulic pressure introduced via an internal passage 55 as will be described later are respectively partitioned.

In addition, internal passage 55 which serves to exhaust the hydraulic pressure within first control oil chamber 31 is structured in the inside of spool valve body 43. Internal passage 55 is drilled in a step difference reduced diameter form from the axial other end side. That is to say, this internal passage 55 has a small diameter section 55*a* formed at one end side of internal passage 55 and communicated with a first connection port 51 via a plurality of communication holes 59 and an annular groove 59*a* connecting communication holes 59 in a state in which spool valve body 43 is placed at an upper end side position in FIG. 1. On the other hand, the communications are interrupted in a state in which spool valve body 43 is placed at the lower end side position as shown in FIG. 8(*b*) and a large diameter section 55*b* formed at the other end side is communicated with back pressure chamber 58 via an inner peripheral side of valve spring 44 while housing valve spring 44.

Figure 7A:
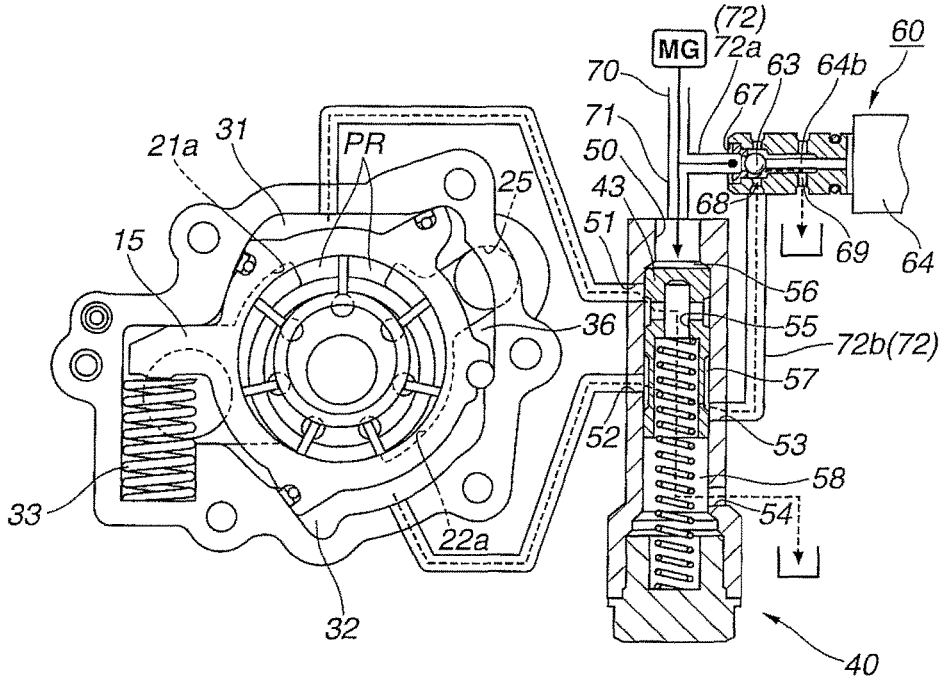
FIGS. 7(*a*) and 7(*b*) are hydraulic pressure circuit diagrams of the variable displacement oil pump related to the first embodiment, FIG. 7 (*a*) representing a pump state in an interval of a in FIG. 6 and FIG. 7(*b*) representing a pump state in an interval of b in FIG. 6.
Figure 7B:
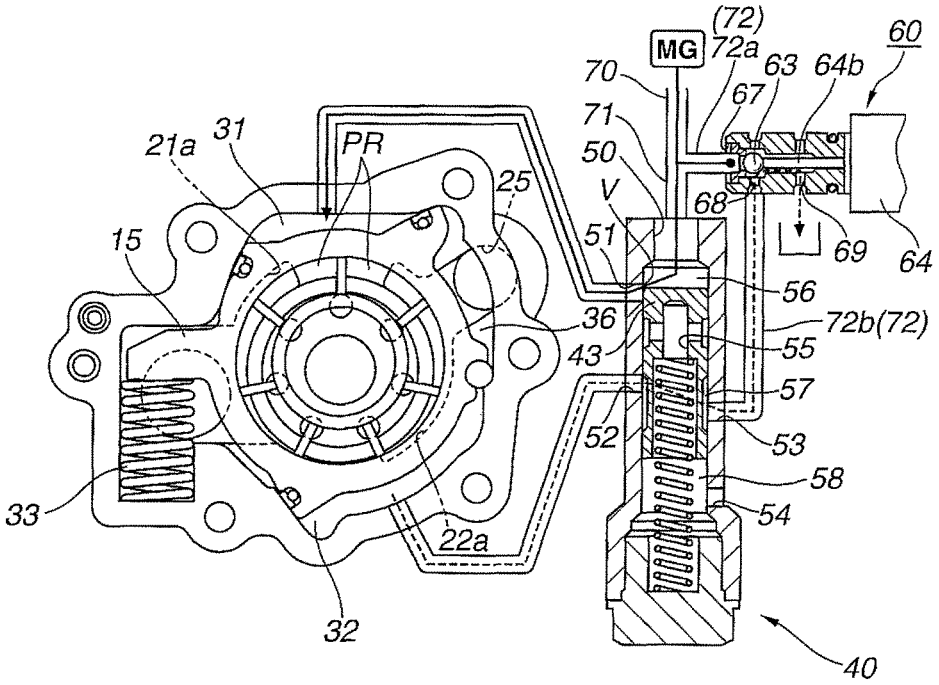

In the structure described above, in pilot valve 40, spool valve body 43 is pressed toward one end side of valve housing section 41*a* (refer to FIG. 7(*a*)) according to the biasing force of valve spring 44 based on set weight W2 in a state in which the control pressure introduced from introduction port 50 into pressure chamber 56 is equal to or below a predetermined pressure (a spool operation hydraulic pressure Ps as will be described later). Consequently, first land section 43*a* closes first connection port 51, the communication between first connection port 51 and introduction port 50 is interrupted, and second connection port 52 and supply/exhaust port 53 are communicated via relay chamber 57.

Figure 8A:
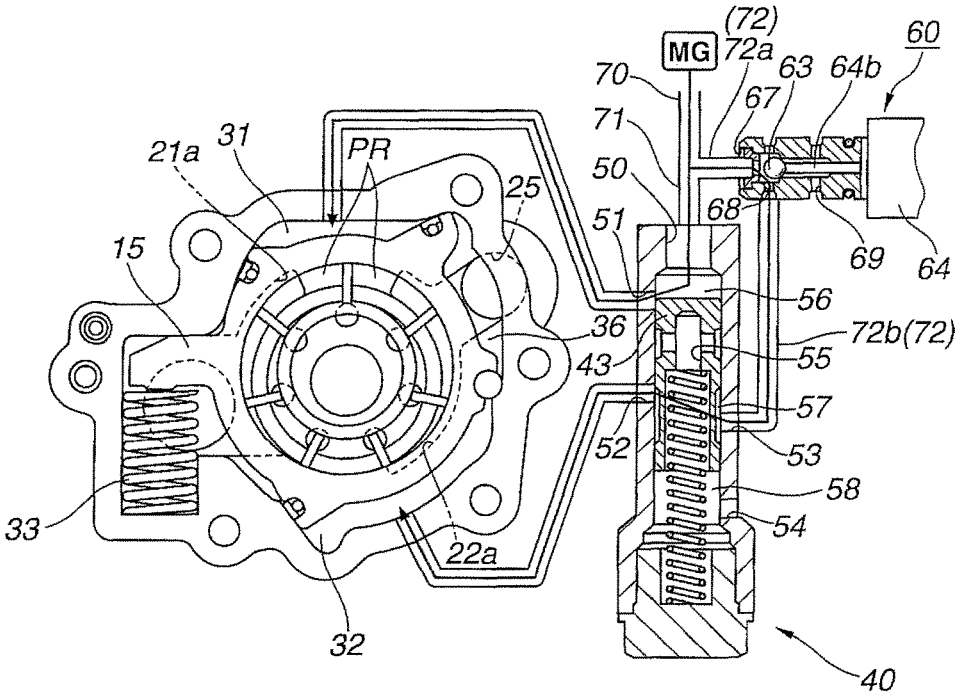
FIGS. 8(*a*) and 8(*b*) are hydraulic pressure circuit diagrams of the variable displacement oil pump related to the first embodiment, FIG. 8(*a*) representing a pump state in an interval of c in FIG. 6 and FIG. 8(*b*) representing a pump state in an interval of d in FIG. 6.
Figure 8B:
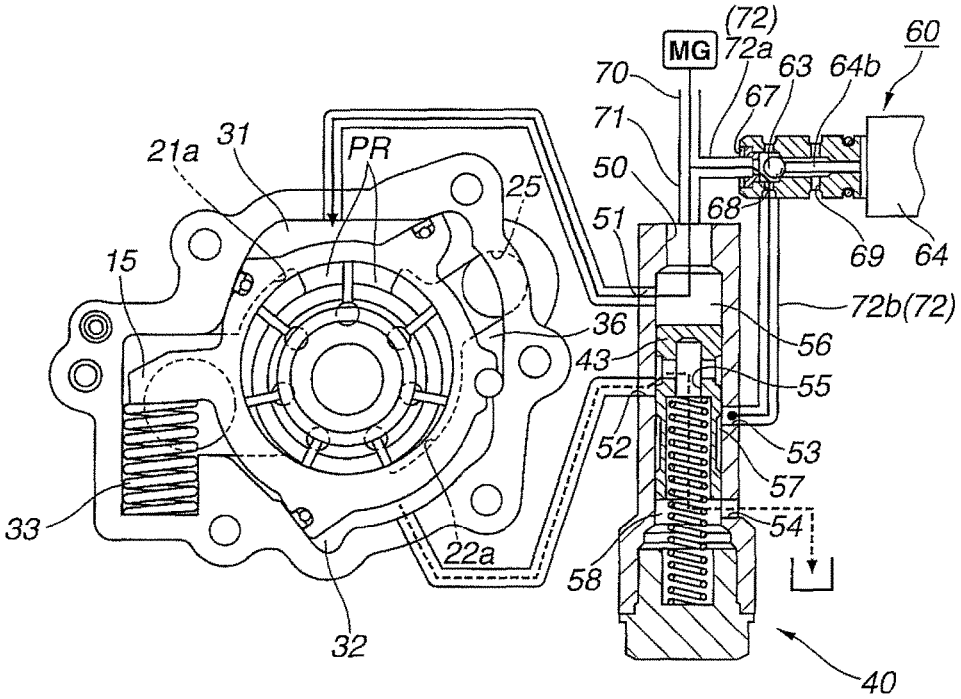

When the control pressure introduced to pressure chamber 56 is in excess of the predetermined pressure, spool valve body 43 is moved to the other end side of valve housing chamber 41*a* against the biasing force of valve spring 44 (refer to FIG. 8(*b*)). Consequently, first connection port 51 is opened by first land section 43*a* so that first connection port 51 and introduction port 50 are communicated via pressure chamber 56, the communication between second connection port 52 and drain port via relay section 57 is interrupted, and second connection port 52 and drain port 54 are communicated via internal passage 55 and so forth.

Figure 5:
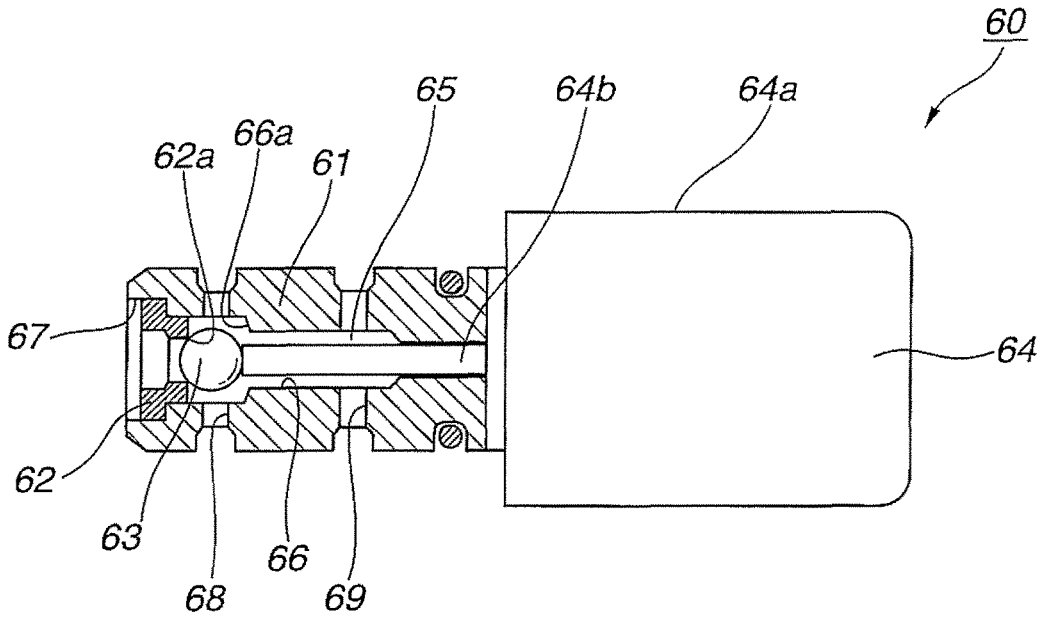
FIG. 5 is an enlarged view of a solenoid valve shown in FIG. 1.

Solenoid valve 60 is, as shown in FIG. 5, mainly constituted by: a substantially cylindrical valve body 61 housed in an internal part of valve housing hole (not shown) intervened in a midway of second introduction passage 72 and having an oil passage 65 penetrated along an internal axial direction; a seat member 62 press fit on an outer end section of a valve body housing section 66 and having an introduction port 67 which is an upstream side opening section connected to an upstream side passage 72*a* (hereinafter, called simply "upstream side passage" at the center section; a ball valve body 63 installed to be enabled to seat or unseat with respect to a valve seat 62*a* formed on an internal end section opening edge of seat member 62 and which serves to open or dose introduction port 67; and a solenoid 64 installed on the other end section (a right side end section in FIG. 5) of valve body 61. Valve body housing section 66 is formed by increasing the diameter of oil passage 65 at one end section (a left side end section in FIG. 5).

In valve body 61, valve body housing section 66 is installed in a step difference increase diameter shape with respect to oil passage 65. Valve body housing section 66 houses a ball valve body 63 in an inner peripheral, section at the one end side of valve body 61. A valve seat 66*a* which is the same as a valve seat 62*a* installed on seat member 62 is formed on an opening edge of an inner end section of valve body housing section 66. Furthermore, supply/exhaust port 68 connected to downstream side passage 72*b* and which serves to supply or exhaust of the hydraulic pressure with respect to pilot valve 40 is penetrated along the radial direction at an outer peripheral section of valve body housing section 66 which is the one end section in the axial direction from among peripheral walls of this valve body 61. A drain port 69 connected to oil pan T is penetrated along a radial direction at an outer peripheral section of oil passage 65 which is the axial other side of the peripheral wall of valve body 61.

Solenoid 64 is constituted by an armature (not shown) arranged at the inner peripheral side of a coil and a rod 64*b* fixed to the armature which are advanced and moved in a left side direction in FIG. 4 according to an electromagnetic force generated by power supplying the coil (not shown) housed within the inside of casing 64*a*. An exciting current is supplied to solenoid 64 from an ECU (not shown) which is mounted in a vehicle on a basis of an engine driving condition detected or calculated according to predetermined parameters such as an oil temperature, a water temperature, and an engine revolution number of the internal combustion engine.

In the structure described above, when the exciting current is caused to flow through solenoid 64, rod 64*b* is advanced and moved, ball valve body 63 arranged at the tip of rod 64*b* is pressed toward valve seat 62*a* of seat member 62 side, the communication between introduction port 67 and supply/exhaust port 68 is interrupted, and supply/exhaust port 68 and drain port 69 are communicated via oil passage 65. On the other hand, when the exciting current is not caused to flow through solenoid 64, ball valve body 63 is retracted and moved on a basis of the control pressure introduced from introduction port 67. Thus, ball valve body 63 is pressed toward valve seat 66*a* of the valve body 61 side. Introduction port 67 and supply/exhaust port 68 are communicated and the communication between supply/exhaust port 68 and drain port 69 is interrupted.

Hereinafter, a characteristic action on an oil pump 10 related to the first embodiment will be explained on a basis of FIGS. 6 through 8(*b*). It should be noted that a solid line in FIG. 6 denotes a case where an exciting current is caused to flow through solenoid 64 and a dot-and-dash line in FIG. 6 denotes a case where the exciting current is not caused to flow through solenoid 64. Pc in FIG. 6 denotes a cam ring operation hydraulic pressure under which cam ring 15 starts the movement in the concentric direction against the biasing force of coil spring 33 based on set weight W1 and Ps in FIG. 6 denotes a spool operation hydraulic pressure under which spool valve body 43 starts the movement from a second position to a third position as will be described later against the biasing force of valve spring 44 based on the set weight W2, respectively.

(Solenoid OFF)

In a state in which the engine revolution speed is low, the exciting current is caused to flow through solenoid 64. As shown in FIGS. 7(*a*) and 7(*b*), the communication between introduction port 67 and supply/exhaust port 68 is interrupted and supply/exhaust port 68 and drain port 69 are communicated. In a state of an interval of a in FIG. 6, in an engine speed low revolution area, pump drain pressure P is lower than cam ring operation hydraulic pressure Pc and spool valve body 43 is held at an introduction port 50 side end position (hereinafter, called "a first position"), as shown in FIG. 7(*a*).

Consequently, first land section 43*a* interrupts the communication between first connection port 51 and pressure chamber 56. First connection port 51 and internal passage 55 are communicated. The oil within first control oil chamber 31 is exhausted into oil pan T via internal passage 55, drain port 54, and so forth. The oil within second control oil chamber 32 is exhausted into oil pan T via relay chamber 57, supply/exhaust port 53, solenoid valve 60, and so forth. Thus, the hydraulic pressure is not acted on first and second control oil chambers 31, 32 and both of first and second control oil chambers 31, 32 provide the atmospheric pressure. The hydraulic pressure (pump drain pressure) is acted only on drain chamber 36 which is directly communicated with drain port 22*a*. Consequently, cam ring 15 is held in a maximum eccentric state and pump drain pressure P is increased in a form of a substantial proportional to engine revolution speed R (interval of a in FIG. 6).

Figure 6:
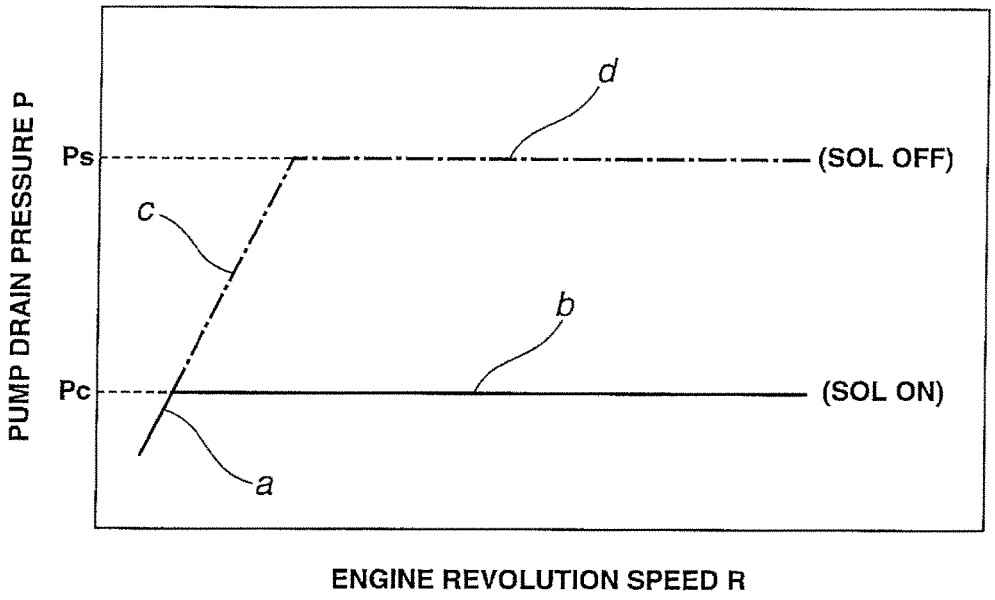
FIG. 6 is a graph representing a hydraulic pressure characteristic of the variable displacement oil pump in the first preferred embodiment.

Thereafter, engine revolution speed R is raised and pump drain pressure P reaches to cam ring operation hydraulic pressure Pc (refer to FIG. 6). At this time, as shown in FIG. 7(*b*), spool valve body 43 is slightly moved toward plug 42 side along with the increase of pump drain pressure P due to the raise of engine revolution speed R (hereinafter, called "second position"). Consequently, first land section 43*a* interrupts the communication between first connection port 51 and internal passage 55, first connection port 51 and pressure chamber 56 are slightly communicated, and the control pressure introduced via a throttle V formed with an overlap between first connection port 51 and first land section 43*a* is introduced into first control oil chamber 31.

On the other hand, second connection port 52 is uninterruptedly connected to oil pan T via relay chamber 57 and so forth and the oil within second control oil chamber 32 is exhausted into oil pan T. Consequently, the hydraulic pressure is not acted on second control oil chamber 32 and the atmospheric pressure is acted thereon. The hydraulic pressure (the control pressure or the pump drain pressure) is acted only on first control oil chamber 31 and drain chamber 36. Consequently, a synthesized force of the biasing forces based on both inner pressures of first control oil chamber 31 and drain chamber 36 overcomes a biasing force W1 of coil spring 33. When cam ring 15 starts movement in the concentric direction, pump drain pressure P is decreased. As compared with a case where cam ring 15 is placed in the maximum eccentric state as described before, the increase quantity of pump drain pressure P is made small.

Then, due to the decrease in this pump drain pressure P, the hydraulic pressure acted on the one end of spool valve body 43 is reduced below cam ring operation hydraulic pressure Pc. Cam ring 15 is moved in the concentric direction according to biasing force W1 of coil spring 33. Spool valve body 43 is moved to introduction port 50 side (first position). The eccentricity of cam ring 15 is returned to a state of FIG. 7(*a*) described above in which the eccentricity of cam ring 15 is again maximum. The states of FIGS. 7(*a*) and 7(*b*) are alternately repeated. That is to say, the connection between first connection port 51 communicated with first control oil chamber 31, drain port 54 via pressure chamber 56, or drain port 54 via internal passage 55 is continuously alternately switched by means of spool valve body 43. Thus, pump drain pressure P provides a substantially flat characteristic (an interval of b in FIG. 6).

(Solenoid ON)

In a state in which the engine revolution speed is high, the exciting current to solenoid 64 is interrupted. As shown in FIGS. 8(*a*) and 8(*b*), introduction port 67 and supply/exhaust port 68 are communicated. On the other hand, the communication between supply/exhaust port 68 and drain port 69 is interrupted. Then, in a state of interval c in FIG. 6 in a high revolution area of the engine, pump drain pressure P is higher than cam ring operation hydraulic pressure Pc and lower than spool operation hydraulic pressure Ps. As shown in FIG. 8(*a*), spool valve body 43 is held at the second position in the same way as FIG. 7(*b*).

Consequently, first connection port 51 is communicated with introduction port 50 via pressure chamber 56 and second connecting port 52 is communicated with supply/exhaust port 53 via relay chamber 57. Thus, the control pressure is supplied to first control oil chamber 31 via throttle V and the control pressure introduced from second introduction passage 72 is supplied to second control oil chamber 32. Each control pressure is acted on first and second control oil chambers 31, 32 and the pump drain pressure is acted on drain chamber 36. Consequently, the biasing force in the eccentric direction constituting a synthesized force between biasing force W1 of coil spring 33 and the biasing force based on the internal pressure of second control oil chamber 32 is in excess of the biasing force in the concentric direction based on both internal pressures of first control oil chamber 31 and drain chamber 36, cam ring 15 is in the maximum eccentric state and pump drain pressure P is increased in a form of substantially proportional to engine revolution speed R (an interval c in FIG. 6).

Thereafter, when the engine revolution speed R is raised and pump drain pressure P reaches to spool operation hydraulic pressure Ps (refer to FIG. 6), as shown in FIG. 8(*b*), spool valve body 43 is further moved toward plug 42 side accompanied with the increase of pump drain pressure P due to the raise in engine revolution speed R against biasing force W2 of valve spring 44 (hereinafter, called "third position"). Consequently, first connection port 51 is communicated with introduction port 50 via pressure chamber 56 having a sufficient opening quantity and, on the other hand, second land section 43*b* interrupts the communication between second connection port 52 and relay chamber 57, second connection port 52 is communicated with drain port 54 via internal passage 55. A sufficient control pressure is supplied to first control oil chamber 31 and the oil within second control oil chamber 32 is exhausted to oil pan T via internal passage 55 and via drain port 54. Thus, the hydraulic pressure (control pressure or pump drain pressure P) is acted only on first control oil chamber 31 and drain chamber 36. Consequently, the biasing force in the concentric direction based on both internal pressures of first control oil chamber 31 and drain chamber 36 is in excess of the biasing force in the eccentric direction by means of biasing force W1 of coil spring 33. Thus, cam ring 15 is moved toward the concentric direction and the increase quantity of pump drain pressure P becomes small.

Then, due to the decrease of this pump drain pressure P, the hydraulic pressure acted on one end of spool valve body 43 is below spool operation hydraulic pressure Ps. Spool valve body 43 is moved toward introduction port 50 side (second position) by means of biasing force W2 of valve spring 44. Second connection port 52 is communicated with supply/exhaust port 53 so that the control pressure is again supplied to second control oil chamber 32. Consequently, cam ring 15 is pushed back toward the eccentric direction and is returned to a state of FIG. 8(*a*) described before in which the eccentricity of cam ring 15 is again increased. The states of FIGS. 8(*a*) and 8(*b*) are alternately repeated. That is to say, the connection between second connection port 52 communicated with second control oil chamber 32, supply/exhaust port 53 (introduction port 67) via relay chamber 57, or drain port 54 via internal passage 55 is continuously alternately switched by means of spool valve body 43. The pump drain pressure P provides a substantially flat characteristic (an interval of d in FIG. 6).

As described above, in oil pump 10 related to the first embodiment, oil can be supplied to the internal combustion engine via drain chamber 36 partitioned with respect to first and second control oil chambers 31, 32 and directly communicated with drain port 22*a*. The oil drained from drain port 22*a* can be supplied to the internal combustion engine without intervention of the oil passage partitioned and superposed in the axial direction of first and second control oil chambers 31, 32. Thus, a large sizing in the axial direction of oil pump 10 can be avoided by the oil passage and the partitioning wall partitioning this oil passage.

In addition, since drain hole 25 is superposed on drain chamber 36, a small sizing in the radial direction of oil pump 10 can be achieved. Oil pump 10 can further be compacted.

In addition, in the first embodiment, drain chamber 36 is structured at the position at which the biasing force is generated in the concentric direction and which is a start end side of drain port 22*a*. Oil can, at an earlier timing, be drained. In addition, the swing force in the eccentric direction of cam ring 15 acted on a basis of the internal pressure of pump chamber PR can be cancelled by the internal pressure of pump chamber PR based on the pump drain pressure which is higher than the control pressure. Consequently, a reduction of an operation delay of cam ring 15 can be achieved under a situation under which the internal pressure of pump chamber PR can be raised when the engine is a high revolution speed, a low oil temperature, and so forth.

Second Embodiment

Figure 9:
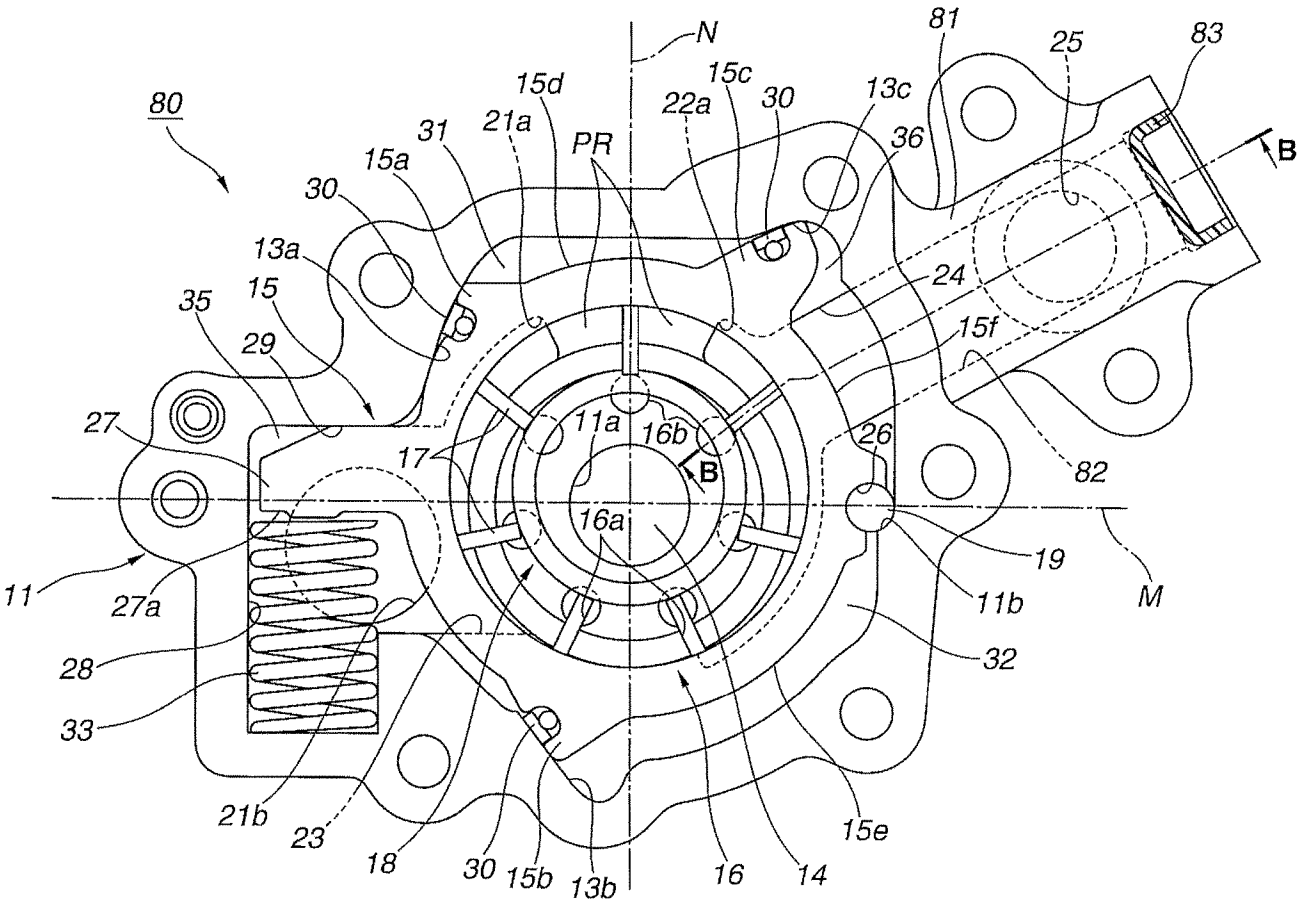
FIG. 9 is an expanded view of the variable displacement oil pump in a second preferred embodiment according to the present invention.
Figure 10:
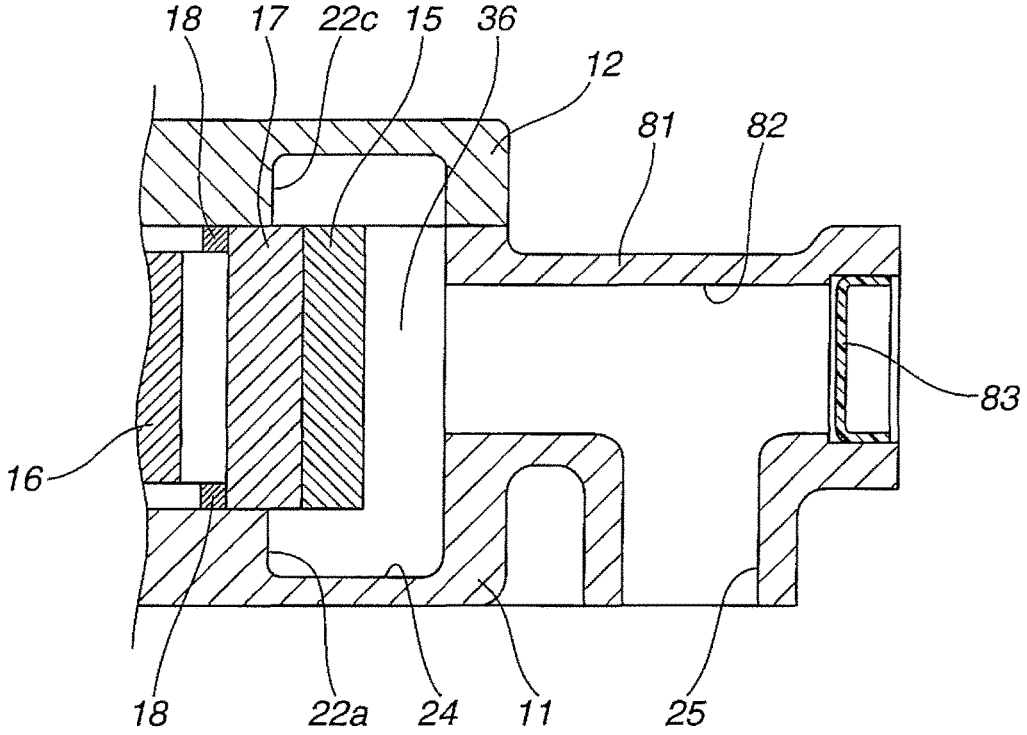
FIG. 10 is a cross sectional view cut away along a line B-B in FIG. 9.

FIGS. 9 and 10 show a second preferred embodiment of the variable displacement oil pump according to the present invention.

In the second embodiment, drain hole 25 is installed outside of drain chamber 36.

It should be noted that, in each of FIGS. 9 and 10, the same elements as the first embodiment are designated by the corresponding reference signs and the detailed description will herein be omitted.

That is to say, in oil pump 80 according to the second embodiment, a substantially cylindrical passage constituent section 81 is radially outwardly extended on the peripheral wall of pump housing chamber 13 of pump body 11. Passage constituent section 81 is communicable with drain chamber 36. A drain passage 82 is provided at an inside of this passage constituent section 81. This drain passage 82 serves to drain oil toward oil main gallery MG. Drain hole 25 which axially opens toward pump body 11 is penetrated at the outer end side of drain passage 82. It should be noted that a reference numeral 83 in FIGS. 9 and 10 denotes a seal plug to close the opening section which is penetrated to work drain passage 82.

In this way, since, in the second embodiment, especially, drain passage 82 is used to offset drain hole 25 outside of drain chamber 36, an improvement of a degree of freedom of the layout of drain hole 25 can be achieved. A versatility of oil pump 80 can furthermore be enhanced.

Third Embodiment

Figure 11:
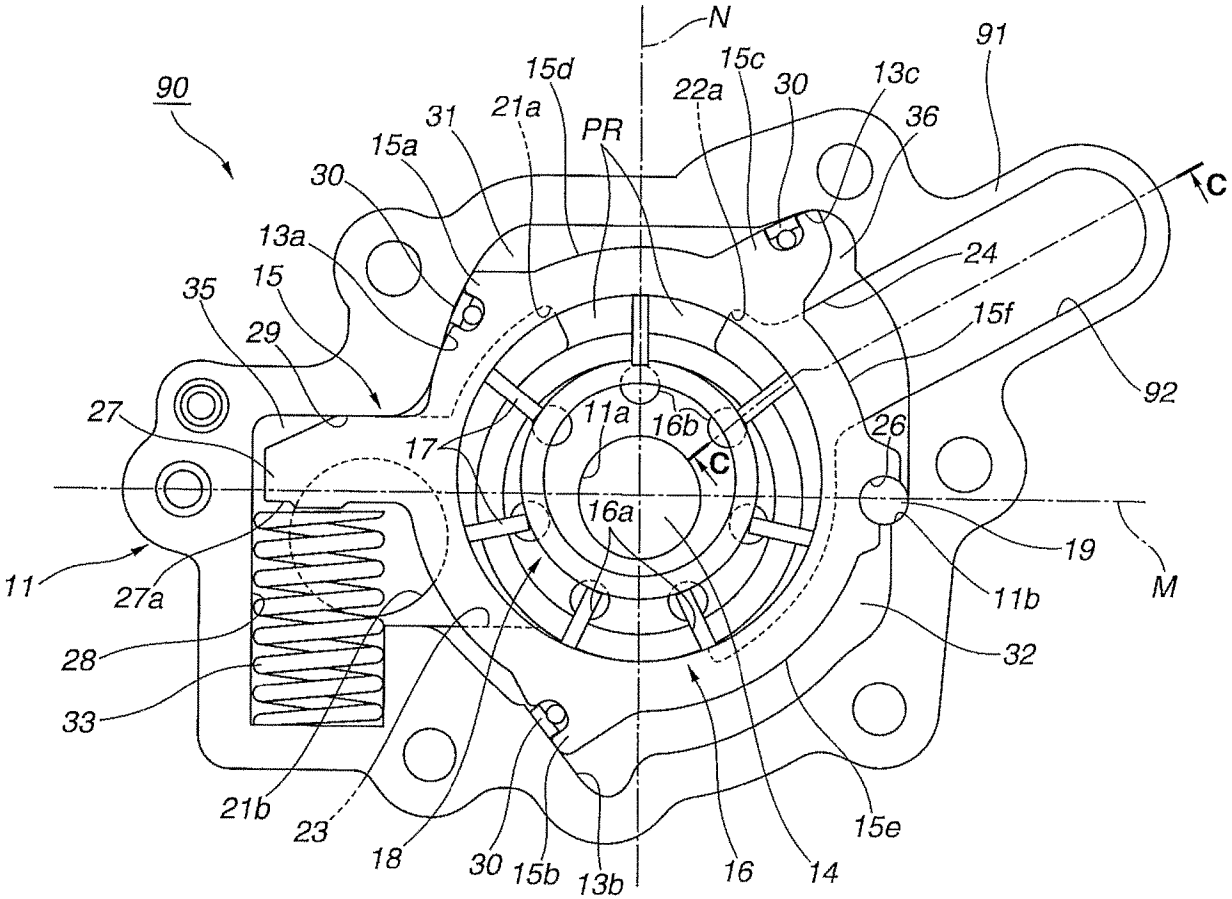
FIG. 11 is an enlarged view of the variable displacement oil pump in a third preferred embodiment according to the present invention.
Figure 12:
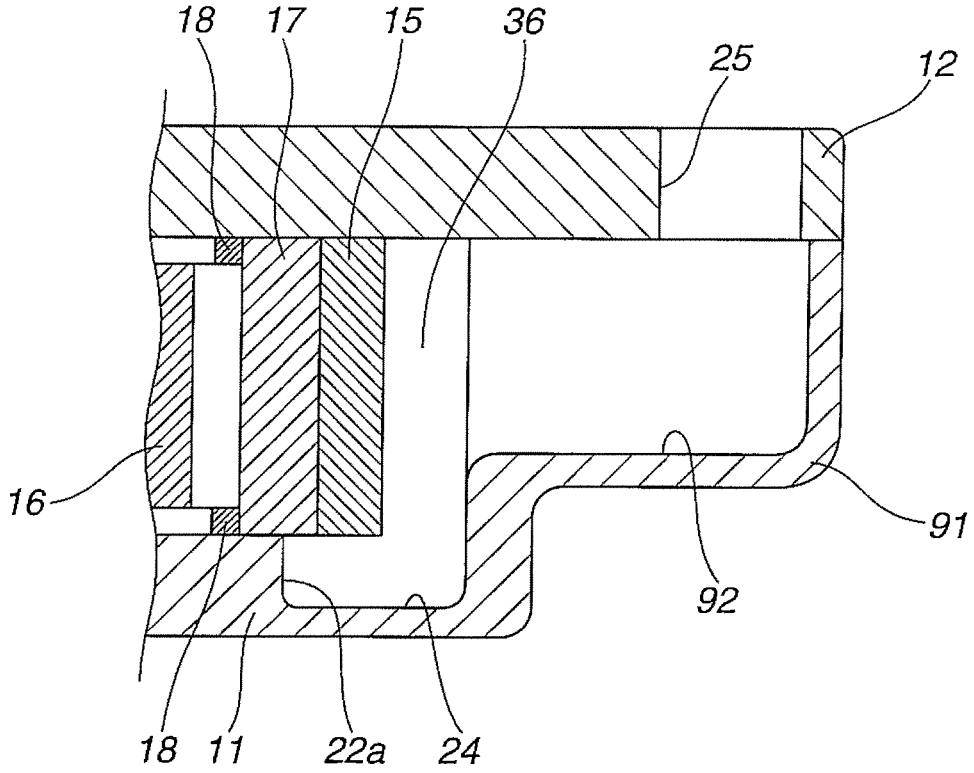
FIG. 12 is a cross sectional view cut away along a line C-C in FIG. 11.

FIGS. 11 and 12 show a third preferred embodiment of the variable displacement oil pump according to the present invention. In the third embodiment, drain hole 25 in the first embodiment is opened at cover member 12 side which is an outside region of drain chamber 36. It should be noted that, in each of FIGS. 11 and 12, the same elements as first embodiment are designated by corresponding reference numeral (signs) and the detailed explanation will herein be omitted.

That is to say, in oil pump 90 in the third embodiment, a passage constituent section 91 is radially outwardly extended on the peripheral wall of pump housing chamber 13 of pump body 11. This passage constituent section 91 is communicable with drain chamber 36. This passage constituent section 91 is opened toward drain chamber 36 side and opened toward cover member 12 side. A junction of cover member 12 constitutes a substantially cylindrical drain passage 92 at an inside of cover member 12. Then, in the third embodiment, drain hole 25 is penetrated through cover member 12. Drain hole 25 serves to drain the oil introduced through drain passage 92 by opening to an outside end section of drain passage 92. The drain oil is taken out from cover member 12 side.

In this way, the third embodiment can basically achieve the same action and effect as the second embodiment. Especially, the third embodiment becomes optimum for a layout taking out the drained oil from cover member 12 side.

Fourth Embodiment

Figure 13:
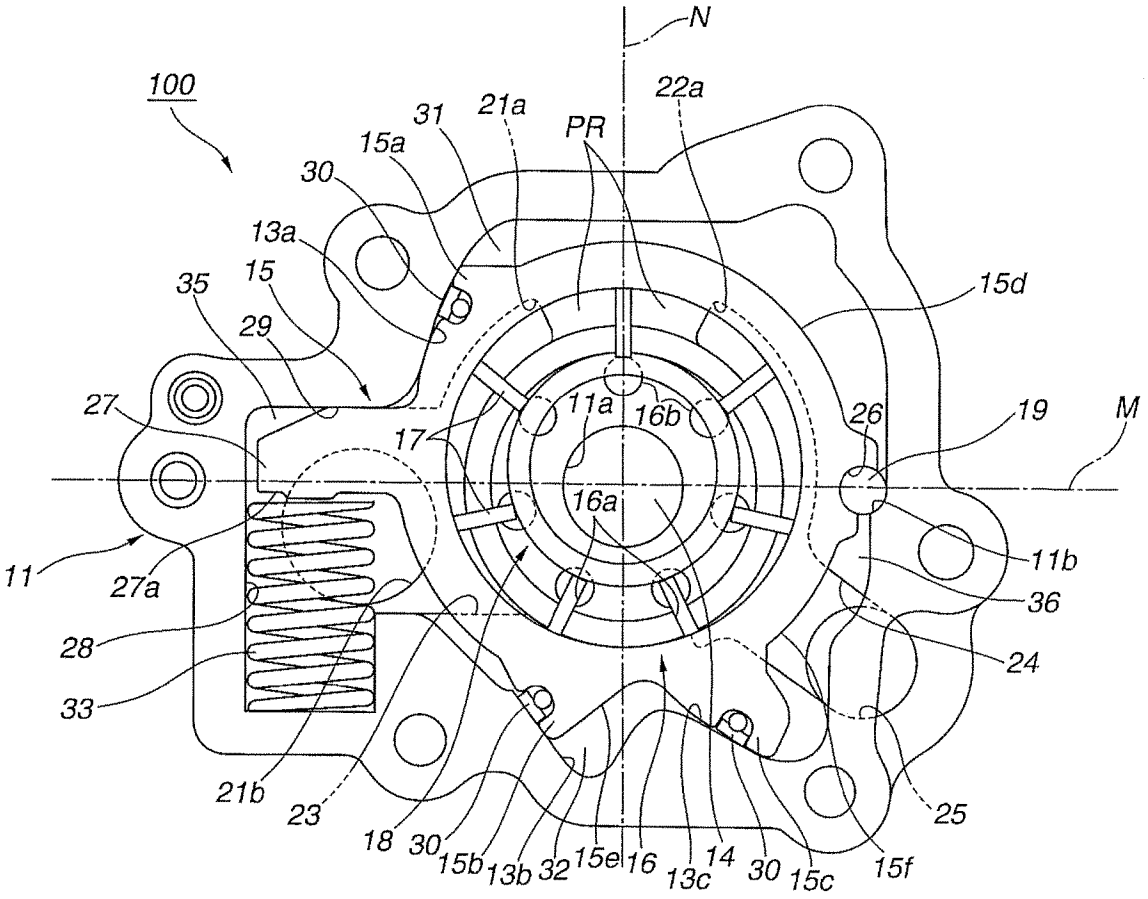
FIG. 13 is an enlarged view of the variable displacement oil pump in a fourth preferred embodiment according to the present invention.

FIG. 13 shows a fourth preferred embodiment of the variable displacement oil pump according to the present invention. In this embodiment, drain chamber 36 in the first embodiment is installed at a position at which the biasing force is generated toward the eccentric direction according to the introduction of the pump drain pressure. It should be noted that the same elements as the first embodiment are designated by the corresponding reference numeral (signs) and the detailed explanation will herein be omitted.

That is to say, in oil pump 100 according to the fourth embodiment, a third seal constituent section 15*c* of cam ring 15 and a third seal slidably contact surface 13*c* of pump housing chamber 13 are installed at positions below cam ring reference line M so that drain chamber 36 is partitioned at a position below same cam ring reference line M and an internal pressure of drain chamber 36 is acted in the eccentric direction. It should be noted that, in order to meet the arrangement of drain chamber 36, communication groove 24 and drain hole 25 are arranged at a terminal end side of drain port 22*a* which is below cam ring reference line M.

In this way, in the fourth embodiment, especially, drain chamber 36 is structured at a position at which the biasing force is generated toward the eccentric direction, namely, at a position of the end side of drain port 22*a* at which an internal volume of pump chamber PR is made small and the internal pressure is more higher. The rise of the internal pressure at a narrow part of pump chamber PR can be suppressed due to the internal pressure of drain chamber 36 based on the pump drain pressure higher than the control pressure. Consequently, reductions of a wasteful work and noise of oil pump 100 can be achieved.

The present invention is not limited to the structures disclosed in the respective embodiments. For example, an engine required hydraulic pressure, cam ring operation hydraulic pressure Pc, spool operation hydraulic pressure Ps, specific structures of pilot valve 40 and solenoid valve 60, and handling of the oil passage can freely be modified in accordance with specifications of the vehicular internal combustion engine in which oil pump 10 is mounted, the valve timing control apparatus, and so forth.

In addition, in the above-described embodiments, the drain quantity is variable by swinging cam ring 15. However, as means for varying the drain quantity, not only the means related to the swing, but may be carried out by moving cam ring 15 straightly in the radial direction. In other words, if the structure which can modify the drain quantity (structure which can modify the volume variation quantity of pump chambers PR), a form of the movement of cam ring 15 does not matter.

In the respective embodiments, the variable displacement vane pump is exemplified. Cam ring 15 is exemplified as a movable member according to the present invention. A variable mechanism is constituted by cam ring 15 swingably disposed, first and second control oil chambers 31, 32, drain chamber 36, and coil spring 33. In a case where the present invention is applied to another type of the variable displacement oil pump, for example, a trochoid pump, an outer rotor constituting an external gear corresponds to the movable member. Then, the outer rotor is disposed eccentrically movably in the same way as cam ring 15 and the control oil chamber and the spring are disposed at the outer peripheral side of the outer rotor to constitute the variable mechanism.

Hereinafter, technical ideas graspable from the respective preferred embodiments will be explained.

(a) The variable displacement oil pump as set forth in claim 4, wherein the pump element is housed in a pump housing having a pump housing chamber formed in a bottomed cylindrical shape, the drain passage is formed integrally with the pump housing, and the drain hole is installed in the pump housing.

(b) The variable displacement oil pump as set forth in claim 4, wherein the pump element is housed in a pump housing constituted by a pump body having a pump housing chamber whose one end side is opened and formed in a substantially bottomed cylindrical shape and a cover member joined to the pump body and which closes one end side opening section of the pump housing chamber, the drain passage is formed integrally with the pump body, and the drain hole is installed in the cover member.

(c) The variable displacement oil pump as set forth in claim 1, wherein a part of the control mechanism is constituted by a pilot valve.

(d) The variable displacement oil pump as set forth in claim 6, wherein the first control oil chamber and the second control oil chamber are arranged at an outer peripheral side of the cam ring and are partitioned by a swing fulcrum of the cam ring installed on the outer peripheral side of the cam ring.

(e) The variable displacement oil pump as set forth in item (d), wherein the drain chamber is installed to be communicated with the drain section at the outer peripheral section at the outer peripheral side of the cam ring.

This application is based on a prior Japanese Patent Application No. 2014-242716 filed in Japan on Dec. 1, 2014. The entire contents of this Japanese Patent Application No. 2014-242716 are hereby incorporated by reference. Although the invention has been described above by reference to certain embodiments of the invention, the invention is not limited to the embodiment described above. Modifications and variations of the embodiments described above will occur to those skilled in the art in light of the above teachings. The scope of the invention is defined with reference to the following claims.

What is claimed is:

1. A variable displacement oil pump, comprising:

a housing having an inner part within which a pump housing chamber is formed;

a pump element including a ring disposed within an inner part of the pump housing chamber and a rotor housed within an inner part of the ring to form a plurality of pump chambers between the rotor and the ring and rotationally driven by an internal combustion engine, the pump element structured to absorb oil in an absorption region at which an inner volume of the plurality of pump chambers is decreased, in association with rotation of the rotor;

an absorption section which is communicated with an absorption region at the inner part of the housing and through which oil is taken into the inner part of the housing;

a drain section which is communicated with a drain region at the inner part of the housing and structured to discharge oil to an outside of the housing;

a variable mechanism which increases or decreases a volume variation quantity of the plurality of pump chambers according to movement of the ring;

a spring installed in a state in which a pre-load is acted and structured to bias the ring in a direction in which a volume variation quantity of the plurality of pump chambers is increased;

a first control oil chamber which serves to generate a biasing force in a direction in which the volume variation quantity of the plurality of pump chambers is decreased for the ring according to a hydraulic pressure introduced into the first control oil chamber from the internal combustion engine, the first control oil chamber being formed between a peripheral wall of the housing forming the pump housing chamber and the ring;

a second control oil chamber which serves to generate the biasing force in a direction in which the volume variation quantity of the plurality of pump chambers is increased for the ring according to the hydraulic pressure introduced into the second control oil chamber from the internal combustion engine, the second control oil chamber being formed between a peripheral wall of the housing forming the pump housing chamber and the ring;

a valve configured to control a hydraulic pressure introduced into each of the first control oil chamber and the second control oil chamber; and a drain chamber formed between the peripheral wall of the housing forming the pump housing chamber and the ring with a separation from the first control oil chamber and the second control oil chamber and interposed in an inner side of the housing between the drain region and the drain section to generate a biasing force in a direction against the biasing force of the spring according to a hydraulic pressure of oil discharged from the drain region, wherein an area of a first part of an outer peripheral surface of the ring which faces against the drain section is smaller than an area of a second part of the outer peripheral surface of the ring which faces the first control oil chamber.

2. The variable displacement oil pump as claimed in claim 1, wherein the drain chamber is installed at a position at which the biasing force is generated in a direction in which the volume variation quantity of the plurality of pump chambers is decreased according to an introduction of a drain pressure.

3. The variable displacement oil pump as claimed in claim 2, wherein a drain hole through which oil drained from the drain section is supplied to the internal combustion engine is connected to the drain section, and the drain hole is superposed on the drain chamber.

4. The variable displacement oil pump as claimed in claim 2, wherein a drain hole through which oil drained from the drain section is supplied to the internal combustion engine is connected to the drain section via a drain passage, and the drain hole is installed at an outside of the drain chamber.

5. The variable displacement oil pump as claimed in claim 4, wherein the pump housing chamber is formed in a bottomed cylindrical shape, the drain passage is integrally formed with the pump housing, and the drain hole is installed in the pump housing.

6. The variable displacement oil pump as claimed in claim 4, wherein the housing is provided with a pump body having the pump housing chamber, the pump housing chamber having one end side that is opened and formed in a bottomed cylindrical shape and a cover member joined to the pump body and which closes one end side opening section of the pump housing chamber, and the drain passage is integrally formed with the pump body, and the drain hole is installed in the cover member.

7. The variable displacement oil pump as claimed in claim 1, wherein the drain chamber is installed at a position at which the biasing force is generated in a direction in which the volume variation quantity of the plurality of pump chambers is increased according to an introduction of a drain pressure.

8. The variable displacement oil pump as claimed in claim 1, wherein a part of the valve comprises a pilot valve.

9. The variable displacement oil pump as claimed in claim 1, wherein at least a portion of the spring is disposed in a vertical direction so as to be between (1) a side of the first control oil chamber that is closer to the rotor than an opposing side of the first control oil chamber and (2) a side of the second control oil chamber that is closer to the rotor than an opposing side of the second control oil chamber.

10. A variable displacement oil pump, comprising:

a housing having an inner part within which a pump housing chamber is formed;

a rotor rotationally driven by an internal combustion engine;

a plurality of vanes housed to be projectable from and retractable into an outer periphery of the rotor;

a ring partitioning a plurality of pump chambers by housing the rotor and the vanes in an inner peripheral side of the ring and increasing or decreasing a volume variation quantity of a plurality of pump chambers by eccentrically moving with respect to the rotor;

an absorption section which is opened to an absorption region in which an internal volume of the pump chambers is increased;

a drain section which is opened to a drain region in which the internal volume of the pump chambers is decreased;

a spring installed in a state in which a pre-load is acted and structured to bias the ring in a direction in which an eccentricity is increased;

a first control oil chamber which serves to generate a biasing force in a direction in which the volume variation quantity of the plurality of pump chambers is decreased for the ring according to a hydraulic pressure introduced into the first control oil chamber from the internal combustion engine, the first control oil chamber being formed between a peripheral wall of the housing forming the pump housing chamber and the ring;

a second control oil chamber which serves to generate the biasing force in a direction in which the volume variation quantity of the plurality of pump chambers is increased for the ring according to the hydraulic pressure introduced into the second control oil chamber from the internal combustion engine, the second control oil chamber being formed between the peripheral wall of the housing forming the pump housing chamber and the ring;

a valve configured to control the hydraulic pressure introduced into each of the first control oil chamber and the second control oil chamber; and a drain chamber formed between the peripheral wall of the housing forming the pump housing chamber and the ring with a separation from the first control oil chamber and the second control oil chamber and interposed in an inner side of the housing between the drain region and the drain section to generate a biasing force in a direction against the biasing force of the spring according to a hydraulic pressure of oil discharged from the drain region, wherein an area of a first part of an outer peripheral surface of the ring which faces against the drain section is smaller than an area of a second part of the outer peripheral surface of the ring which faces the first control oil chamber.

11. The variable displacement oil pump as claimed in claim 10, wherein the first control oil chamber and the second control oil chamber are arranged on an outer peripheral side of the ring and are partitioned by a swing fulcrum of the ring installed on the outer peripheral side of the ring.

12. The variable displacement oil pump as claimed in claim 11, wherein the drain chamber is installed to be communicated with the drain section at the outer peripheral side of the ring.

13. The variable displacement oil pump as claimed in claim 10, wherein at least a portion of the spring is disposed in a vertical direction so as to be between (1) a side of the first control oil chamber that is closer to the rotor than an opposing side of the first control oil chamber and (2) a side of the second control oil chamber that is closer to the rotor than an opposing side of the second control oil chamber.

* * * * *